US007059971B1

(12) United States Patent
Schmitt

(10) Patent No.: US 7,059,971 B1
(45) Date of Patent: Jun. 13, 2006

(54) GOLF PUTTER WITH BALL AND MARKER RETRIEVING FEATURES

(76) Inventor: Stephen R. Schmitt, 1072 Olde Forge Crossing, Lancaster, PA (US) 17601

( * ) Notice: Subject to any disclaimer, the term of this patent is extended or adjusted under 35 U.S.C. 154(b) by 1 day.

(21) Appl. No.: 10/862,080

(22) Filed: Jun. 7, 2004

Related U.S. Application Data

(60) Provisional application No. 60/501,342, filed on Sep. 9, 2003.

(51) Int. Cl.
*A63B 47/02* (2006.01)
*A63B 53/04* (2006.01)

(52) U.S. Cl. ..... 473/285; 473/286; 473/340

(58) Field of Classification Search ..... D21/721; 473/285–286, 340–341; 294/19.2
See application file for complete search history.

(56) References Cited

U.S. PATENT DOCUMENTS 3,374,027 A * 3/1968 Jacobs ..... 294/19.2
5,368,302 A * 11/1994 Thomas ..... 473/286
5,417,426 A * 5/1995 Bayer ..... 473/285
6,170,088 B1 * 1/2001 Tate ..... 2/209.13

* cited by examiner

*Primary Examiner*—Stephen Blau
(74) *Attorney, Agent, or Firm*—Miller Law Group, PLLC

(57) ABSTRACT

A putter used for playing the game of golf has a putter body formed with a vertical opening sized to engage the diametric circumference of a golf ball to permit the golf ball to be elevated by the putter. The putter body is sized to permit insertion into the cup formed in the surface of the green to engage a golf ball at the bottom of the cup for removal therefrom. The putter body is also formed with a magnetic ball marker retriever positioned along a peripheral edge of the putter body to permit the magnetic attraction of a ball marker for elevation thereof from the surface of the green. The putter permits a golf ball to be elevated and a ball marker to be placed on the surface of the green, as well as be retrieved from the surface of the green without requiring the player to bend over.

15 Claims, 7 Drawing Sheets

Fig. 9
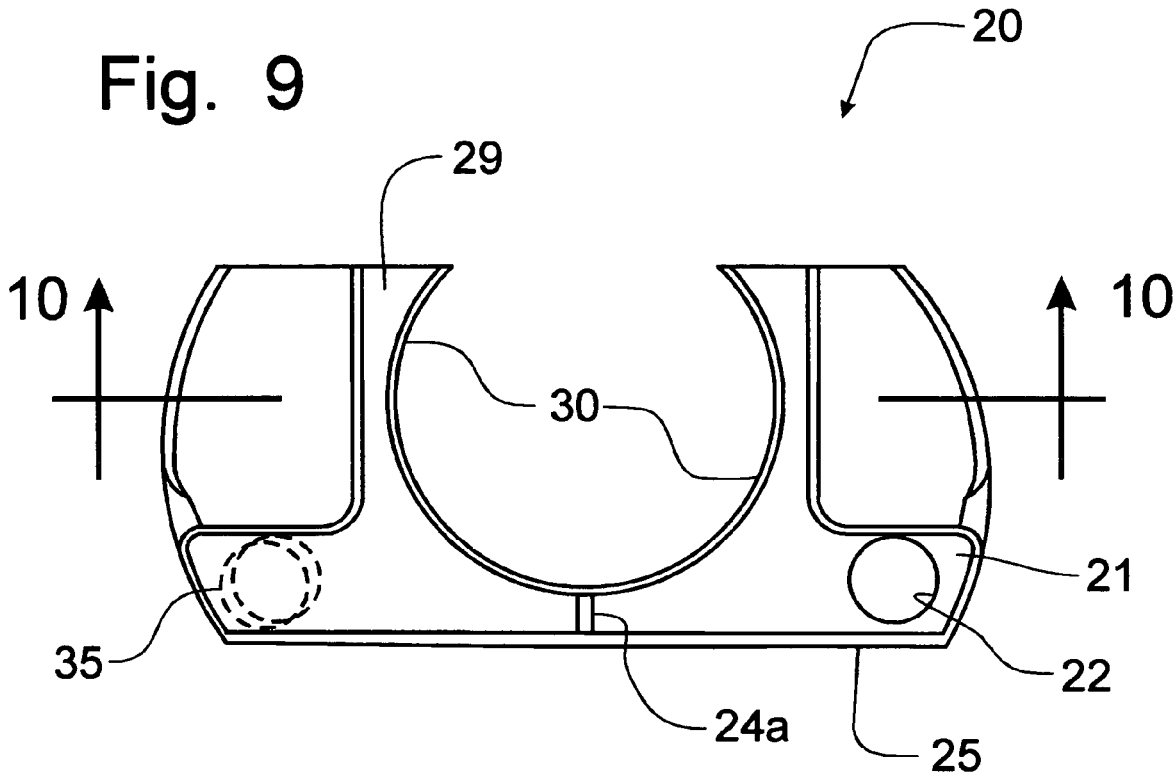
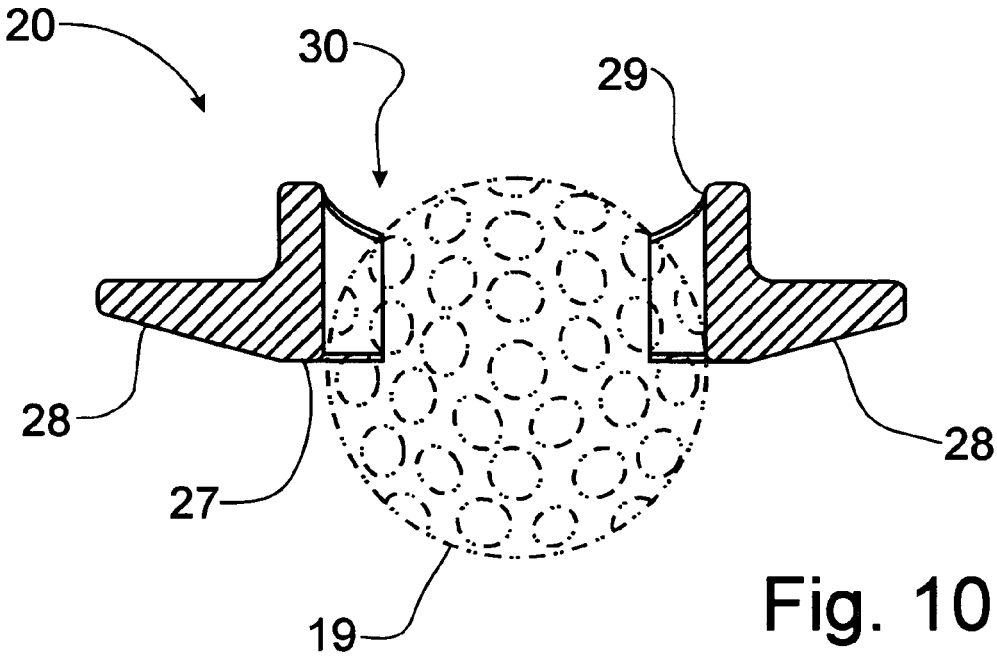
Fig. 10

GOLF PUTTER WITH BALL AND MARKER RETRIEVING FEATURES

CROSS-REFERENCE TO RELATED APPLICATIONS

This application claims domestic priority on U.S. Provisional Patent Application Ser. No. 60/501,342, filed Sep. 9, 2003, the contents of which are incorporated herein by reference.

BACKGROUND OF THE INVENTION

The present invention relates generally to a golf putter, and, more specifically, to a putter having the ability to retrieve a golf ball from the bottom of the cup in the green.

Of the golf clubs available to a golfer, the putter has been a club to which a great deal of attention has been directed. Putting typically accounts for almost half of the strokes made by a golfer in completing a round of golf. Accordingly, considerable attention has been directed to improvements in reducing the number of putts a golfer must make to place the golf ball into the hole formed into the green. Putters have evolved in shape and style over the years. One of the most recent improvements that are commercially available is the "two ball" putter in which the top surface of the putter is elongated in the direction of normal movement during utilization to accommodate a pair of aligned images of golf balls in order to visually facilitate the proper alignment of the actual golf ball to be directed to the hole.

Putters have also been used as instructional aids. One known version available over the Internet is a putter with an elongated body, extending in the direction of the normal stroke of the putter during utilization that will accommodate a vertical opening that extends through the entire body of the putter. This opening is slightly larger than the nominal diameter of the golf ball so that the ball is free to roll along the ground within the opening as the putter is moved along the surface of the green. By this process, the putting stroke is practiced. This vertical opening through the putter body is intentionally larger than the diameter of the golf ball so that the ball freely rolls while restrained within the opening in the putter body. Accordingly, the vertical opening is not capable of engaging the circumference of the golf ball to enable the golf ball to adhere to the putter body.

The hole placed into the green on a golf course is selectively placed by the greens keeper in one of a number of predetermined locations on the green by retracting a plug of sod and dirt and inserting a rigid cup member into the formed hole. Typically, the cup member is formed from plastic, though other rigid materials, such as aluminum can also be utilized. The bottom of the cup member is typically fluted and sloped to position the ball dropped into the cup member into the center of the bottom of the cup member. Accordingly, the bottom of the generally cylindrical cup member is sloped from the outer perimeter toward the center at approximately fifteen degrees from the horizontal orientation. Often the center portion of the bottom of the cup member is sized to receive a golf ball.

Golf is a game that does not necessarily require great physical exertion in order to play. Accordingly, the game of golf is played by elderly people and by people having back, or even extremity (e.g. leg or knee), problems that limit the golfer's ability to bend over to retrieve the golf ball from the surface of the ground, let along from the bottom of the cup member. It would, therefore, be desirable to provide a device that would be capable of use by a golfer to position and/or retrieve a golf ball without requiring the golfer to bend over to reach for the ball.

One of the conventional practices associated with putting during a game of golf is the marking of your ball when your ball is in the path of travel of your opponent's ball that is further from the hole than your ball. By using a flat ball marker and removing your ball from the surface of the green, the ball is neither a distraction nor a impediment to the movement of your opponent's ball. The placement of a marker onto the surface of the green to mark the position of your golf ball typically involves bending over to properly place the mark adjacent the golf ball before the ball is removed from the surface of the green. As noted previously, the game of golf is often played by elderly people and those whose physical condition will not easily permit the requisite bending of the back in order to properly place a ball marker.

Accordingly, it would be desirable to provide an apparatus that will facilitate the placement of a ball marker by a golfer without requiring the golfer to bend his back to do so.

SUMMARY OF THE INVENTION

It is an object of this invention to overcome the disadvantages of the prior art by providing a putter that can be used to retrieve the golf ball from the bottom of the cup without requiring the player to bend over.

It is another object of this invention to provide a putter having a putter body that is formed with an opening therein that can receive a golf ball for engagement thereof to enable a lifting of the golf ball into the air.

It is a feature of this invention that the opening in the putter body is sized to be slightly less than the diameter of a standard golf ball.

It is an advantage of this invention that the circumference of the opening in the putter body compresses the cover of a golf ball to permit the golf ball to be trapped in the opening.

It is another advantage of this invention that the golf ball, once trapped in the opening in the putter head, can be elevated above the surface of the ground.

It is another feature of this invention that the opening in the putter body can be capped or left open.

It is still another feature of this invention that the golf ball can be extracted from engagement with the opening by pushing against the top of the ball.

It is still another advantage of this invention that a golf ball can be engaged while in the cup below the surface of the ground and elevated into the grasp of the player without requiring the player to bend his back to reach the ball.

It is still another object of this invention to provide a ball marker magnet within the putter body.

It is yet another feature of this invention that the ball marker magnet is operable to attract and engage a ferrous ball marker that is positioned on the surface of the ground.

It is yet another advantage of this invention that the ball marker can be picked-up from the surface of the green without requiring the player to bend over to reach the ball marker.

It is still another advantage of this invention that the ball marker can be placed on the surface of the green to mark the location of a golf ball without requiring the player to bend over to place the ball marker at the desired spot.

It is still another feature of this invention that a putter body can be formed to incorporate both an opening for the engagement of a golf ball and a magnetic ball marker retriever.

It is a further advantage of this invention that a putter having a body provided with both an opening for retrieving a golf ball and a magnetic ball marker retrieving device can both mark and remove a ball from the surface of the green without bending over.

If is yet another object of this invention to reduce the number of time a player has to bend over during the playing of the game of golf.

It is still a further advantage of this invention that a player having back problems can enjoy a greater comfort level while playing the game of golf.

It is yet another feature of this invention that the magnetic ball marker retriever can be utilized to both pick-up ball markers from the surface of the green and to place ball markers on the surface of the green.

It is a further object of this invention to provide a golf club having a putter body incorporating an opening for engaging a golf ball and a magnetic ball marker retrieving device that is durable in construction, inexpensive of manufacture, carefree of maintenance, facile in assemblage, and simple and effective in use.

These and other objects, features and advantages are accomplished according to the instant invention by providing a putter used for playing the game of golf having a putter body formed with a vertical opening sized to engage the diametric circumference of a golf ball to permit the golf ball to be elevated by the putter. The putter body is sized to permit insertion into the cup formed in the surface of the green to engage a golf ball at the bottom of the cup for removal therefrom. The putter body is also formed with a magnetic ball marker retriever positioned along a peripheral edge of the putter body to permit the magnetic attraction of a ball marker for elevation thereof from the surface of the green. The putter permits a golf ball to be elevated and a ball marker to be placed on the surface of the green, as well as be retrieved from the surface of the green without requiring the player to bend over.

BRIEF DESCRIPTION OF THE DRAWINGS

The advantages of this invention will be apparent upon consideration of the following detailed disclosure of the invention, especially when taken in conjunction with the accompanying drawings wherein:

FIG. 9 is a top plan view of a second alternative embodiment of the putter body, similar to that of FIG. 2;

FIG. 10 is a cross-sectional view of the second alternative embodiment of the putter body taken along lines 10—10 of FIG. 9;

DETAILED DESCRIPTION OF THE PREFERRED EMBODIMENT

Figure 1:
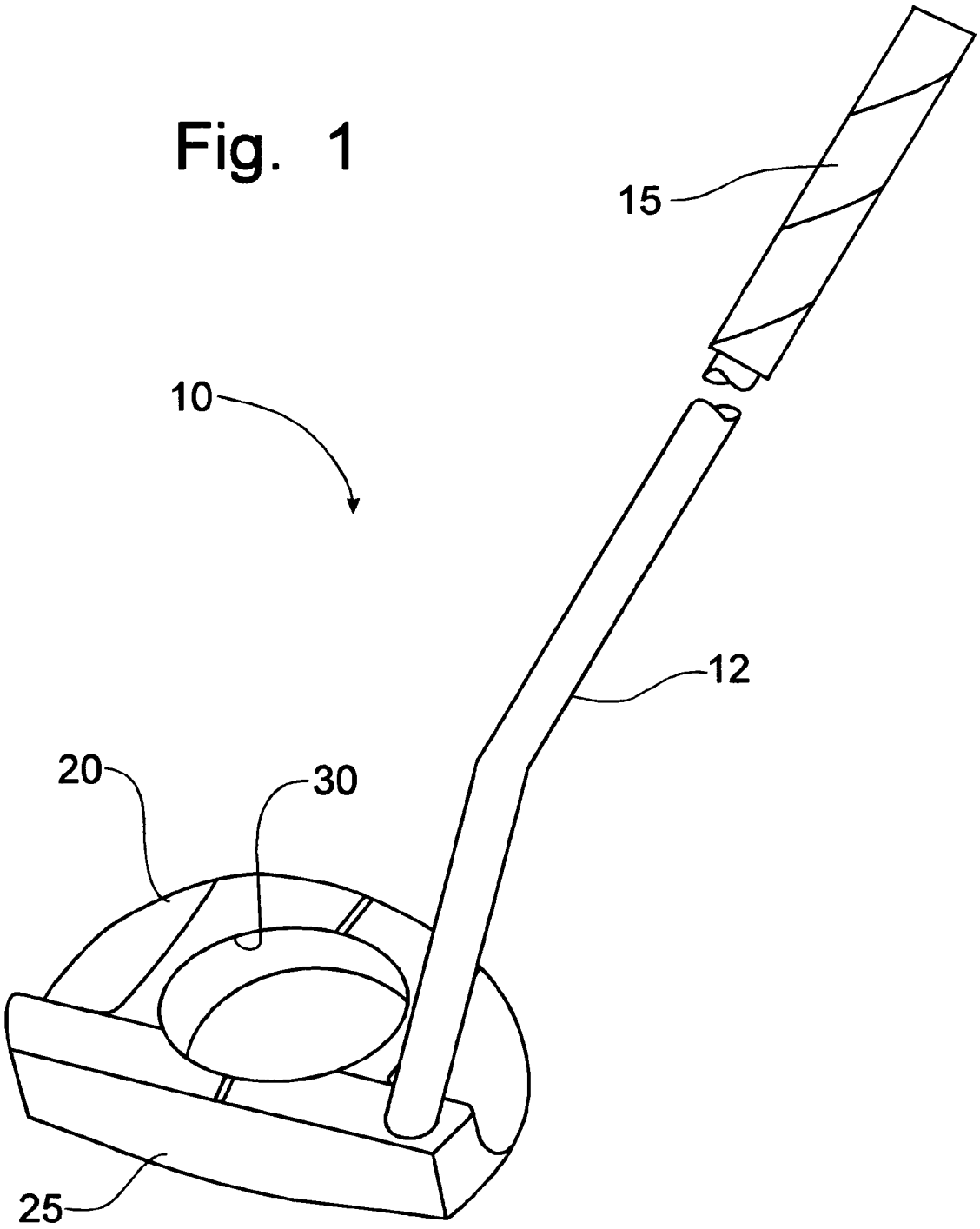
FIG. 1 is an elevational view of a putter incorporating the principles of the instant invention, a portion of the shaft of the putter being broken away for purposes of clarity.
Figure 2:
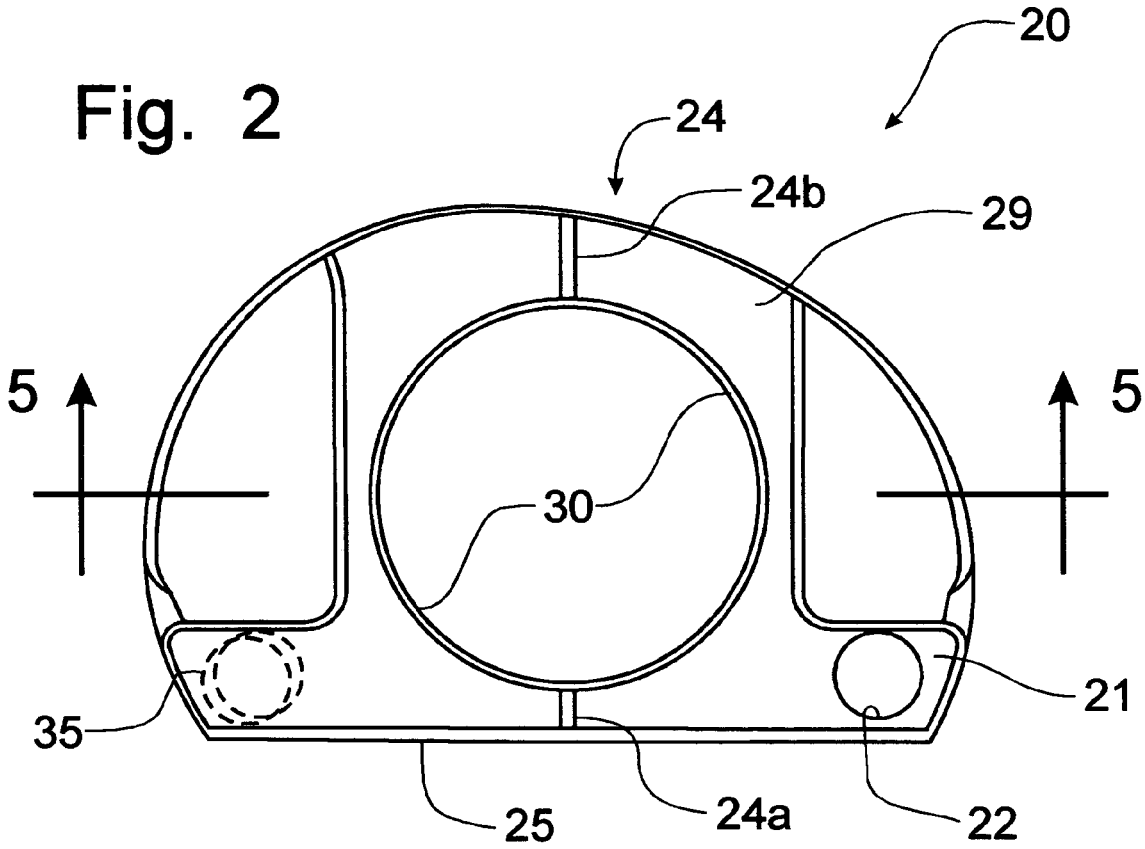
FIG. 2 is a top plan view of the putter body incorporating the principles of the instant invention.
Figure 3:
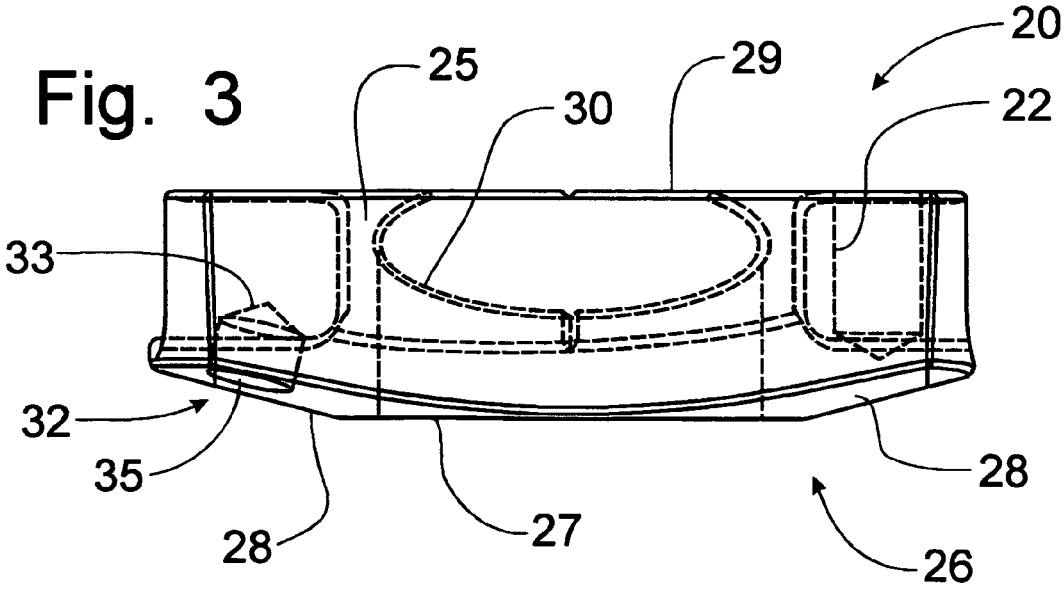
FIG. 3 is a front elevational view of the putter body shown in FIG. 2 looking into the face of the body that strikes the golf ball.
Figure 4:
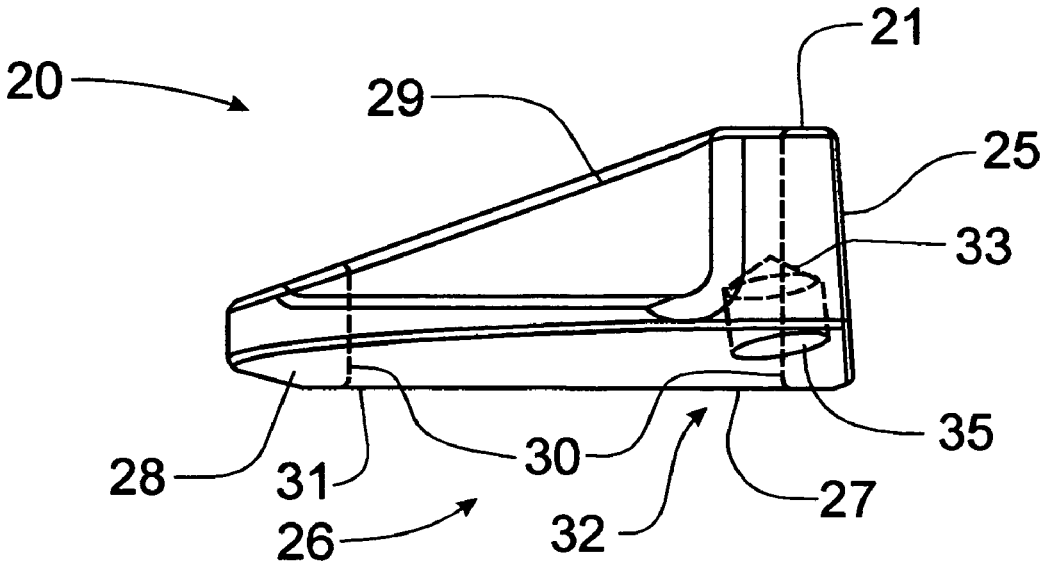
FIG. 4 is a side elevational view of the putter body taken orthogonally with respect to the view of FIG. 3.

Referring now to FIGS. 1–7, a golf putter incorporating the principles of the instant invention can best be seen. The putter 10 is formed of a putter body, sometimes referred to as the putter head, 20 having a generally upright shaft 12 attached to the putter body 20 to extend generally vertically thereof. The shaft 12 terminates in a handle 15 typically formed of a leather wrap that enhances the gripping of the shaft 12 during the putting operation. The putter body 20 includes a generally planar and generally vertical face 25 that is used to strike the golf ball to move the ball along the surface of the putting green (not shown). For proper operation of the putter 10, the face 25 is formed with a slight deflection from a true vertical alignment preferably at about four degrees, as is best seen in FIG. 4.

Referring now to FIGS. 2–7, the details of the putter body 20 can best be seen. The putter body 20 is can be formed with substantially any configured shape, provided that the depth of the putter body 20 measured perpendicularly to the face 25 is sufficient to accommodate the vertical opening 30, as will be described in greater detail below. As depicted in the drawings, the overall shape of the putter body 20 is preferably an asymmetrical ovoid shape, though a circular configuration truncated at the face 25 would also be a preferred embodiment. From front to back, with the face 25 being at the front of the putter body 20, the putter body 20 preferably slopes generally downwardly so that the rear of the putter body 20 has a smaller height than the face 25, as is best seen in FIG. 4. The front portion 21 of the putter body 20 immediately behind the face 25 has a uniform thickness in terms of height of the putter body 20 to provide structure for the mounting of the shaft 12. To this end, a hole 22 is drilled into the top of the front portion 21 to receive the shaft 12 and mount the putter head 20 to the shaft 12 to form the putter 10.

Preferably, the putter body 20 is formed from 303 stainless steel that provides a good feel for the putter 20 and is easier to machine than 304 stainless steel. The putter body 20 is formed in a wedge shape with the putter body 20 being thinner at the rear than at the front face 25 to provide an aesthetically pleasing shape and to manipulate the weight of the putter body 20. Even though the putter body 20 has an extended depth extending rearwardly from the face 25, the weight of the putter body 20 can be maintained at about three-quarters of a pound to provide a pleasing feel for the putter 10.

A vertical hole 30 is formed through the putter body 20 generally centrally with respect to the face 25. The diameter of the vertical opening 30 is formed at about 1.660 inches, which is about 20 thousandths of an inch smaller than the diameter of a standard golf ball. Therefore, the placement of the putter body 20 over the top of a standard dimpled golf ball 19, as depicted in phantom in FIG. 5, will result in the golf ball 19 engaging the circumference of the vertical opening 30 with the bottom edge 31 of the vertical opening 30 being located just above the center of the golf ball 19. Because of the plastic cover employed on golf balls 19 and the dimpling in the surface thereof, the golf ball 19 will become jammed in the vertical opening 30, allowing frictional forces to retain the golf ball 19 within the vertical opening 30 as the golf ball 19 is lifted above the surface of the ground.

Because the diameter of a standard cup member used on PGA golf greens is about four (4) inches, the maximum width of the putter body 20 must be less than four inches to permit the putter body 20 to be inserted into the cup member to retrieve a golf ball at the bottom of the cup. Preferably, the maximum width of the putter body 20 will be about 3.5 inches to provide a little room for movement of the putter body 20 within the confines of the cup member to properly engage the golf ball 19. The transverse width of the face 25 would be about 3.09 inches. Preferably, a sight line 24 is formed along the transverse centerline of the putter body 20 with one portion 24*a* being located between the vertical opening 30 and the front face 25 and a second portion 24*b* being located behind the vertical opening 30.

Figure 5:
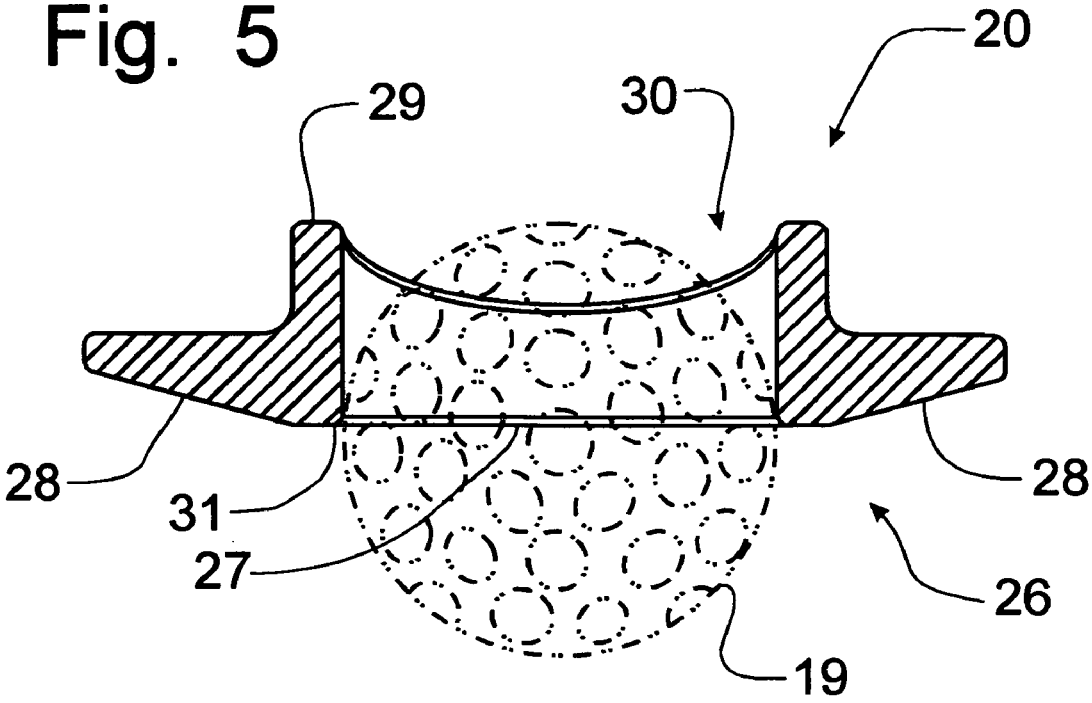
FIG. 5 is a cross-sectional view through the putter body taken along lines 5—5 of FIG. 2, a representative golf ball being depicted in phantom as engaged with the vertical opening through the putter body.
Figure 6:
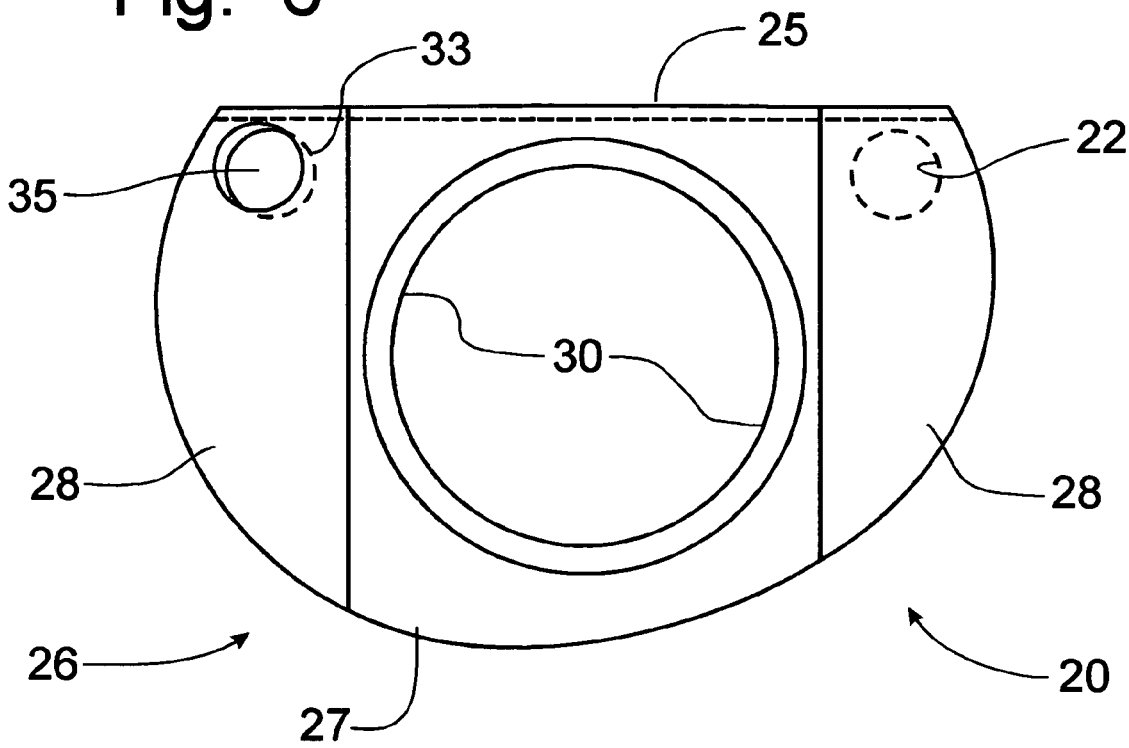
FIG. 6 is a bottom plan view of the putter body depicted in FIGS. 2–5.
Figure 7:
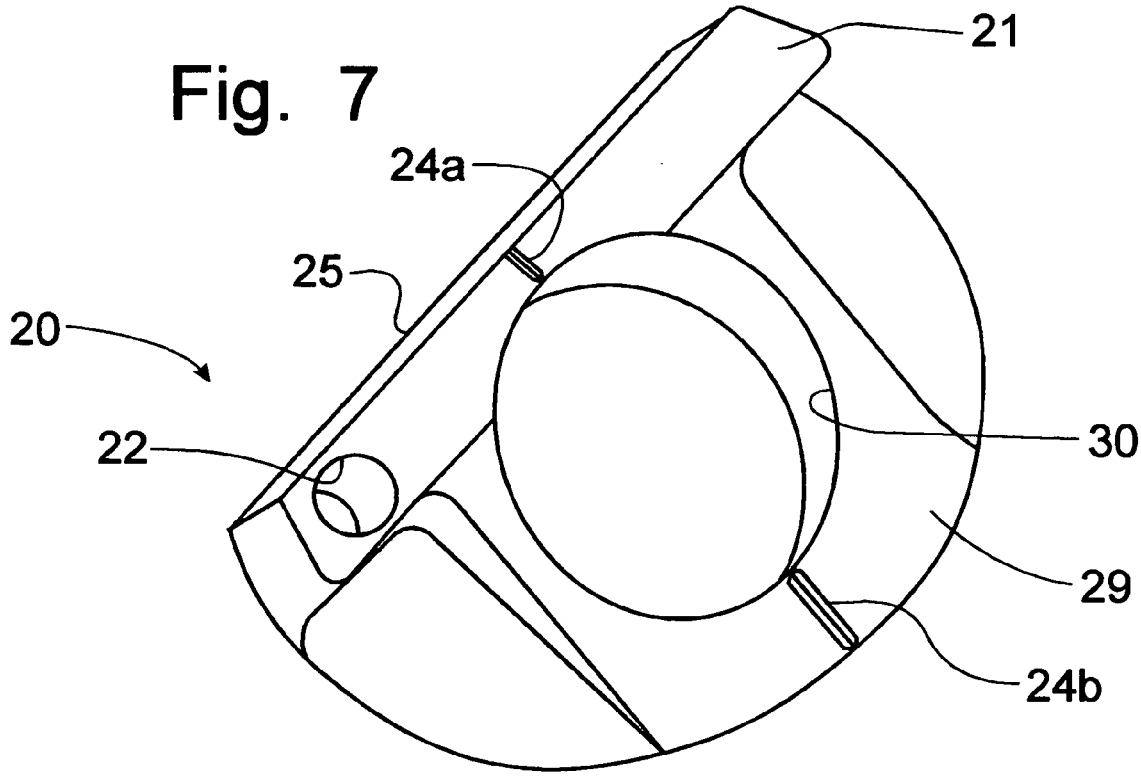
FIG. 7 is a top perspective view of the putter body shown in FIGS. 2–6.

Referring now to FIGS. 3, 5 and 6, one skilled in the art will recognize that the bottom surface 26 is formed with a central planar portion 27 defining a generally horizontal plane extending from the face 25 rearwardly to the rearward edge of the putter body 20. The transverse width of the central planar portion 27 is slightly greater than the diameter of the vertical opening 30 so that the vertical opening 30 is centered transversely on the central planar portion 27. To either side of the central planar portion 27 lies a wing portion 28 that also presents a planar surface that is angled with respect to the central planar portion 27 at an acute angle of approximately 15 degrees. The angled wing portions 28 on the bottom surface 26 permit the putter body 20 to descend deeper into a cup member to retrieve a golf ball 19 therefrom. If the bottom surface were shaped into a single plane, the sloped bottom portion of a conventional cup member would prevent the putter body 20 from properly engaging the golf ball 19 so that the surface of the golf ball 19 is frictionally engaged with the perimeter of the vertical opening 30.

The wing portion 28 on the opposite side of the central planar portion 27 from the hole 22 in which the shaft 12 is engaged with the putter body 20 is provided with a hole 33 for the insertion of a round magnet 35. The magnet 35 will attract a ferrous metallic ball marker (not shown) and hold the ball marker against the wing portion 28 until brushed off against the surface of the green. Thus, when a golf ball on a green needs to be marked and then removed from the surface of the green, the player can raise his putter 10 to attach a ferrous ball marker to the bottom of the putter body 20 against the magnet 35. By then pressing the ball mark against the grass on the green next to the golf ball and sliding the putter body 20 along the surface of the green, the ball marker will be removed from the wing portion and deposited next to the golf ball. The golf ball can then be picked-up by engaging the vertical opening 30 over the golf ball 19 until the golf ball 19 is frictionally engaged by the circumference of the vertical opening 30, all of which can be accomplished without the player bending his back.

Alternatively, the hole 33 can be filled with a ferrous metal plug (not shown) that is attracted to magnets. By forming the ball marker from magnetic material the ball marker will still have magnetic attraction to permit the ball marker retrieving device 32 to work properly. The operation for the placement and retrieval of the ball marker will be substantially identical to that described above for both placing and retrieving a ball marker. Since the remainder of the putter body 20 is formed from non-magnetically attractive material, such as stainless steel, aluminum, or even glass, a magnetic ball marker would only be attracted to the ferrous plug positioned in the hole 33. Furthermore, the non-magnetically attractive putter body 20 would not transfer magnetic properties from the magnet 35 placed into the hole 33 as described with respect to the preferred embodiment identified above.

Figure 8:
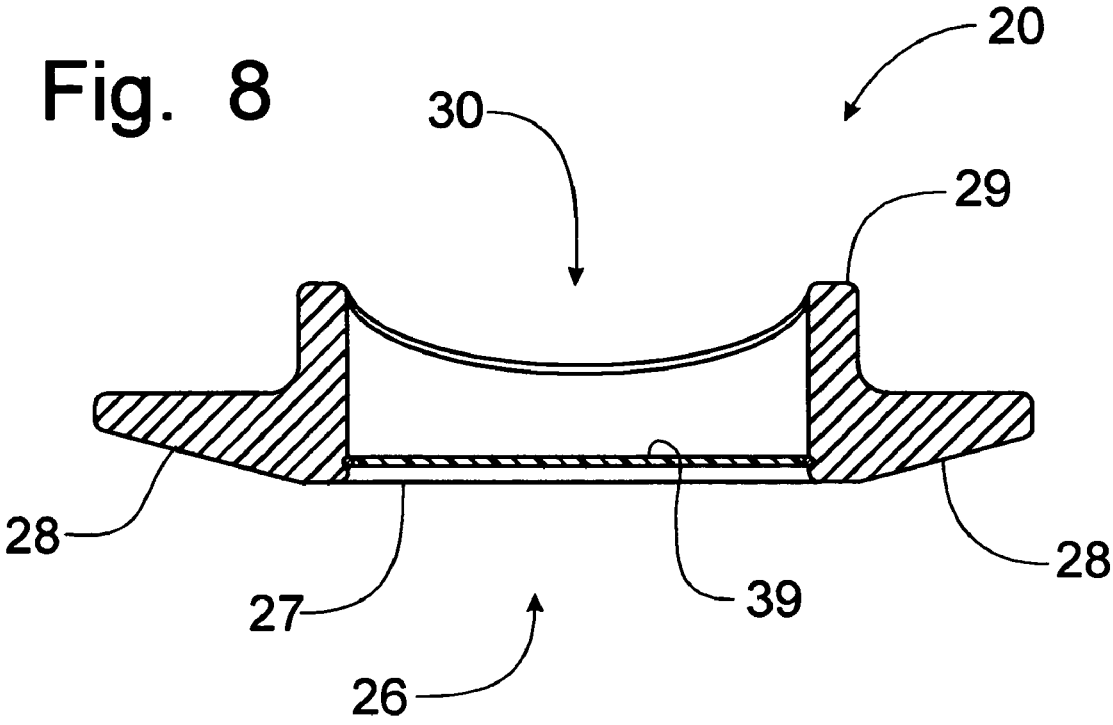
FIG. 8 is a cross-sectional view, similar to that of FIG. 5, but showing an alternative embodiment of the putter body.

Referring now to FIGS. 8–11, alternative embodiments of the instant invention can best be seen. In FIG. 8, the vertical opening 30 is formed with a diameter that is larger than the nominal diameter of a standard golf ball. An O-ring gasket 39 is seated within a groove formed in the circumference of the vertical opening 30 such that the effective diameter of the opening defined by the O-ring 39 is less than the nominal diameter of a golf ball 19. The operation of the putter body 20 to pick-up a golf ball 19 is essentially the same as that described above with respect to the embodiment of FIGS. 1–7, except that the frictional engagement is between the O-ring gasket 39 and the exterior surface of the golf ball 19. While the O-ring gasket 39 can be affixed, such as by gluing, to the groove formed in the circumference of the vertical opening 30, a disadvantage of this embodiment is that the O-ring gasket 39 can disengage from the groove and hinder the operation of the putter 10 to pick-up golf balls 19.

In FIGS. 9 and 10, the shape of the putter body 20 is truncated such that the rear portion of the putter body 20 is eliminated cutting through the vertical opening 30 in a manner to delete about 90 to 160 degrees of the circumference of the vertical opening 30. The vertical opening 30 will be effective to frictionally engage the surface of a golf ball 19 if more than half of the circumference remains intact. At a practical minimum, approximately 200 degrees of the circumference would be needed to provide proper and effective operation of the putter body 20 in picking-up a golf ball 19. Preferably, about 270 degrees of the circumference, as is depicted in FIGS. 9 and 10, would be most desirable in the event a part of the vertical opening 30 is eliminated.

Figure 11:
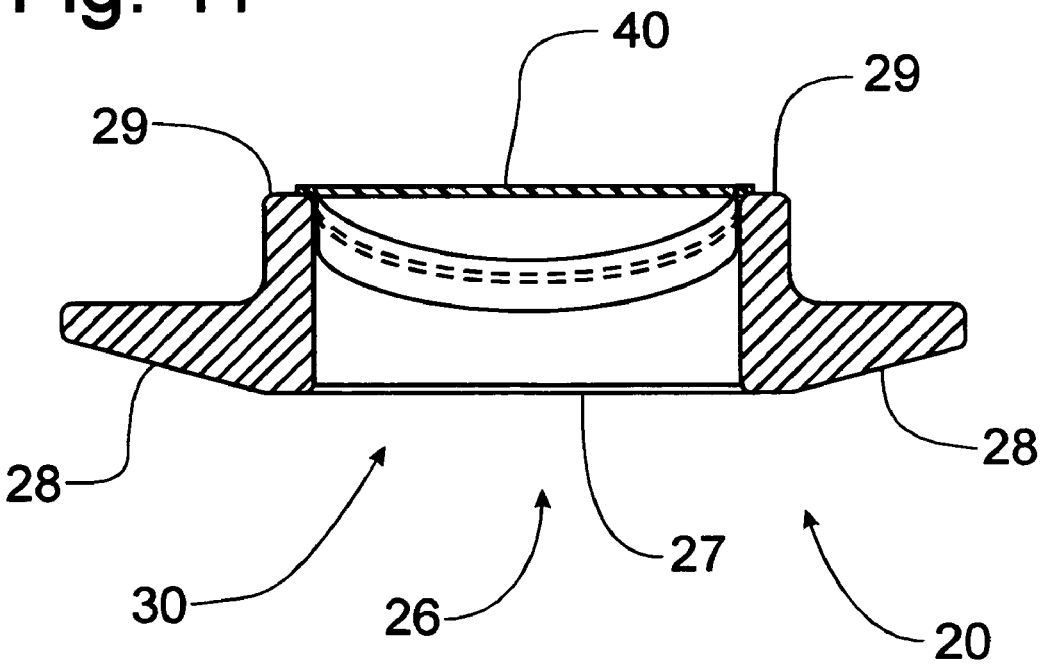
FIG. 11 is a cross-sectional view, similar to that of FIGS. 2 and 10, of a third embodiment of the putter body but with the vertical opening being covered by an elastomeric cap to close the top of the vertical opening.

In the third embodiment of the instant invention reflected in FIG. 11, the top surface of the vertical opening 30 is closed, effectively leaving only a depression into the bottom surface 26 of the putter body 20 for the engagement of the golf ball 19. In the event a player is distracted by the visibility of the grass through the vertical opening 30 extending completely through the putter body 20, as is depicted in the embodiment of the invention shown in FIGS. 2–7, the putter body 20 can be re-shaped to be more box-like with the top surface 29 presenting a solid image. In other words, the vertical opening 30 is drilled into the bottom surface 26 of the putter body 20 and is not extended completely through the putter body 20 to breach the top surface 29. The putter body 20 would have to be re-shaped from the wedge configuration depicted in FIGS. 2–7 because the putter body 20 would have to provide sufficient vertical depth to accommodate almost half of the sphere of the golf ball 19 within the vertical opening 30.

A preferred variation of this third embodiment of FIG. 11, which is specifically depicted in FIG. 11, is to drill the vertical opening 30 completely through the putter body 20 to breach both the bottom and top surfaces 26, 29. A flexible cap member 40 made from rubber or other elastomeric material can then be inserted into the vertical opening 30 on the top surface 29 so that the player using the putter 10 to putt the golf ball 19 on the green will not be distracted by seeing grass move through the vertical opening 30. Another advantage of using an elastomeric cap 40 to close off the top of the vertical opening 30 is that the wedge shape of the putter body 20 would not have to be as drastically changed, and may not have to be changed at all from the configuration depicted in FIGS. 2–7. Engaging the golf ball 19 into the vertical opening 30 through the bottom surface 26 can deflect the elastomeric cap 40 upwardly to accommodate the receipt of the about half of the ball sphere. The golf ball 19 can then be released from the putter body 20 by pressing on the top of the elastomeric cap 40 to push the golf ball 19 back through the vertical opening 30. Imprinting two golf ball images, or partial images, on the top of the elastomeric cap 40, can configure the elastomeric cap 40 to simulate the "two ball" putter. Alternatively, the top of the elastomeric cap 40 can be imprinted with a variety of symbols and/or other graphics to advertise.

Figure 12:
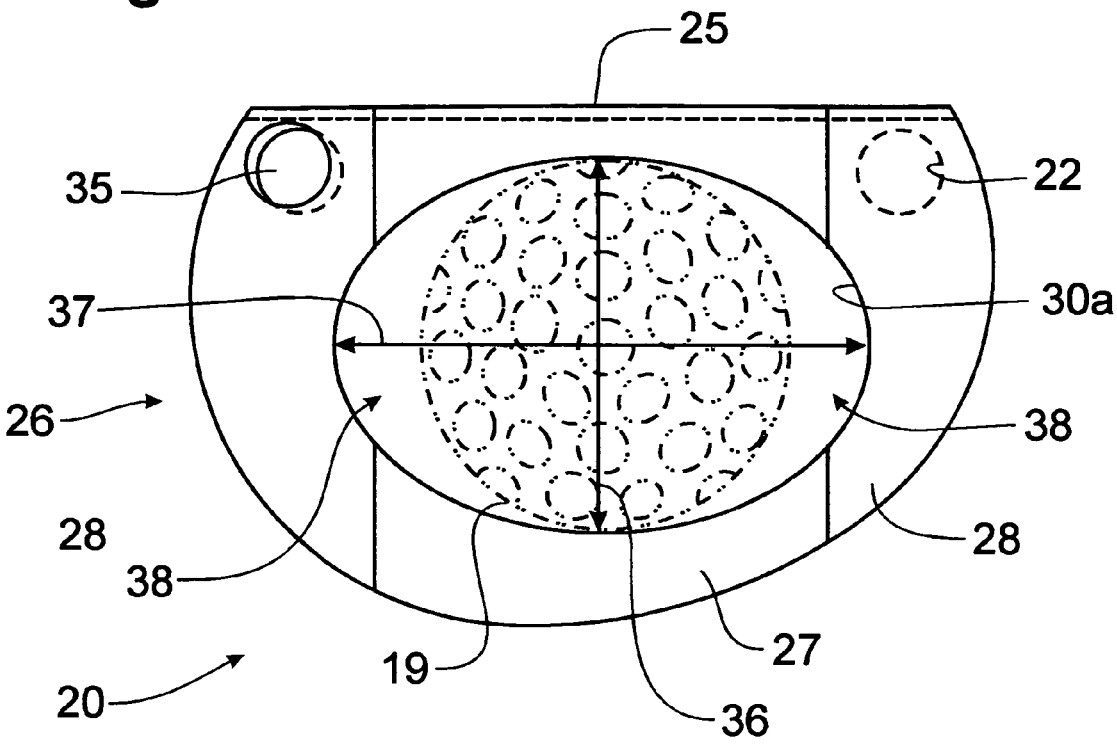
FIG. 12 is a bottom plan view of still another alternative embodiment of the instant invention.
Figure 13:
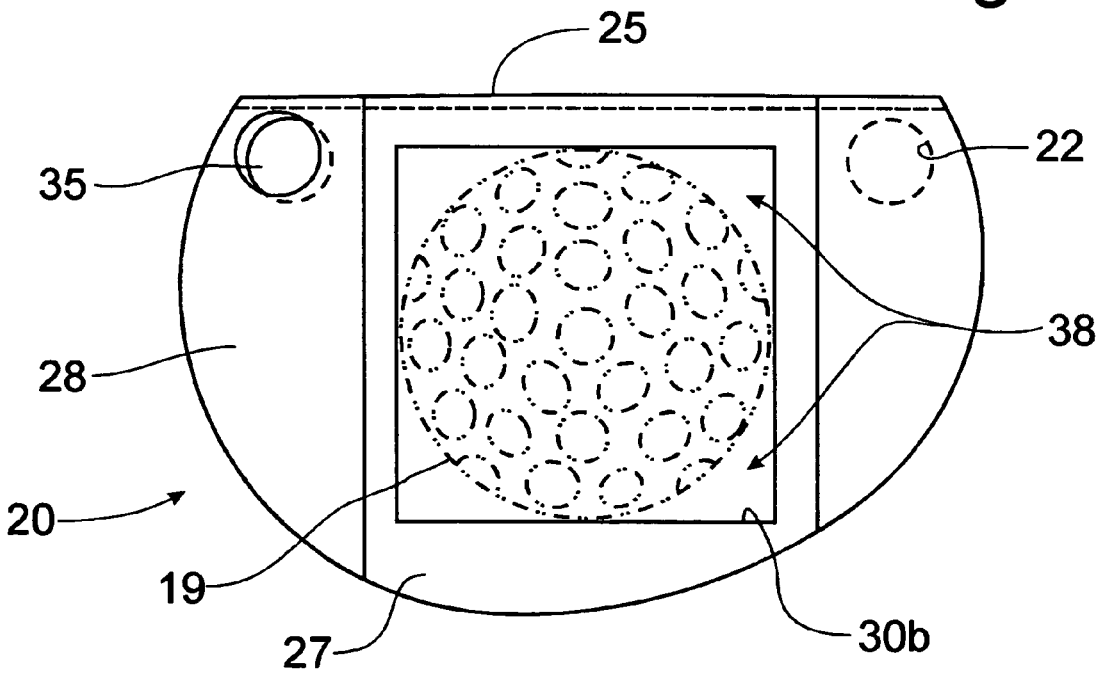
FIG. 13 is a bottom plan view of yet another alternative embodiment of the instant invention comprising a variation of the vertical opening as depicted in FIG. 12.

Referring now to FIGS. 12 and 13, additional embodiments of the instant invention can best be seen. One skilled in the art will recognize that the vertical opening 30, as is described above with respect to FIG. 11, does not have to extend entirely through the putter body 20. By drilling or otherwise forming a depression in the bottom surface 26 of the putter body 20 that does not extend completely through the putter body 20, a problem is encountered with respect to the extraction of the golf ball 19 from the vertical opening 30 formed as a depression into the bottom surface 26 of the putter body 20. Extraction of the golf ball 19 can be facilitated by the formation of the opening 30 into a shape other than a circle so that finger grip openings will be available to the side of the ball.

One such configuration can be seen in FIG. 12 in which the vertical opening 30*a* is formed as an oval shape. As is noted above with respect to FIGS. 9 and 10, the entire circumference of the golf ball 19 does not need to be engaged to enable the golf ball 19 to be retrieved from the ground or from the bottom of the cup member. In fact, sufficient contact to retrieve the golf ball 19 can be attained by having the vertical opening 30 engage the golf ball 19 on opposing sides of the ball 19. By keeping the minor axis 36 of the oval-shaped opening 30*a* equal to the diameter of the opening 30 described above, the golf ball 19 will be adequately engaged on two diametrically opposing sides thereof and will be gripped by the putter body 20. Since the major axis 37 of the oval-shaped opening 30*a* has a length greater than the minor axis 36, a gap 38 is formed between the golf ball 19 and the sides of the opening 30*a* to enable fingers to be eased along the ball 19 to extract the ball 19 from the putter body 20.

Other shapes for the vertical opening 30 can also be envisioned within the scope of the instant invention, including a rectangular or square opening 30*b*, as is depicted in FIG. 13. A square opening 30*b* having sides of a length equal to the diameter of the vertical opening 30 as discussed above, will provide engagement with the golf ball 19 along four sides, which would be more than adequate to permit a lifting of the golf ball 19 from the cup member. The corners of the square (or rectangular) opening 30*b* will form the gap 38 sufficient to allow fingers to urge the golf ball 19 from out of engagement with the putter body 20. Other shapes for the vertical opening 30 would also be a triangle, as well as other non-regular shapes, so long as adequate contact with the perimeter of the golf ball 19 can be obtained to facilitate the vertical lifting of the ball 19. Another variation of this embodiment is to add finger grooves (not shown) to the opposing sides of a circular vertical opening 30, as is depicted in FIGS. 2–6, to permit access to the sides of the golf ball 19 for extraction thereof.

In operation, the putter 10 can be used to retrieve a golf ball 19 from the surface of the ground or from the bottom of a cup member by lowering the putter body 20 over the golf ball 19, or into the cup member or on top of the ground, and frictionally engaging the surface of the golf ball 19 with the effective circumference of the vertical opening 30. Because of the plastic nature of the standard golf ball covering, the cover of the golf ball will deform slightly to adhere to the lower portion of the vertical opening 30, allowing the golf ball 19 to be raised vertically with the putter body 20. The player can then push the golf ball 19 out of the vertical opening 30 to retrieve the golf ball 19 without bending his back to do so.

The positioning of a ball marker can be accomplished through the use of the magnet 35 on the bottom surface 26 of the putter body 20. The ball marker, having a ferrous material incorporated therein, can be manually placed on the magnet 35 and then lowered to the surface of the ground and rubbed off by sliding the putter body 20 along the grass surface of the green. The golf ball 19 can then be retrieved by engaging the vertical opening over the golf ball 19, as noted in the preceding paragraph. The ball marker can be retrieved after the golf ball 19 is returned to the ground by tapping the magnet 35 onto the ferrous ball marker to magnetically engage the ball marker to be raised for manual removal from the putter body 20.

The typical round of golf involves a large amount of bending to retrieve balls and to place ball markers, perhaps 50 to 60 times each round. By the use of a putter manufactured in accordance with the principles of the instant invention, substantially all bending to retrieve balls and to place ball markers can be eliminated. The elderly and those with physically limitations restricting their ability to bend over can particularly enjoy such an advantage.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

What is claimed is:

1. A putter used for playing a game of golf comprising:

a putter body having a ball striking face formed on a front side of said putter body for striking a golf ball during said game of golf, said putter body including a bottom side, a top side, and a rear side generally opposite to said front side, said bottom side having a central planar portion and a wing portion positioned laterally from said central planar portion, said wing portion being angled upwardly from said central planar portion wherein said wing portion has a step decrease in height between said front side and said rear side near said front side;

a generally vertical opening formed into said bottom side of said putter, said opening having a minimum dimension separating two opposing surfaces, said minimum dimension being slightly smaller than a diameter dimension of said golf ball to permit said opposing surfaces of said vertical opening to engage opposing sides of said golf ball so that said golf ball can be wedged in said opening;

a magnetic ball marker retrieval device mounted in a second opening formed in said wing portion of said bottom surface such that said ball marker retrieval device does not engage the surface of the ground as said central planar portion is engaged with the ground; and said putter body being formed with a size and configuration to permit the insertion of said putter body into a standard golf cup placed into the surface of a golf green, said generally vertical opening being positioned in a generally central location so that said opening can engage a golf ball located in said standard golf cup.

2. The putter of claim 1 wherein said generally vertical opening extends through said putter body passing through both said top and bottom surfaces.

3. The putter of claim 1 wherein said generally vertical opening is circular, said minimum dimension being a diameter dimension of said circular opening.

4. The putter of claim 1 wherein said second opening is positioned adjacent said front side rearwardly of said ball striking surface and adjacent to one end of said ball striking surface.

5. The putter of claim 4 wherein said magnetic ball marker retrieving device includes a magnet mounted in said second opening, said magnet attracting a ball marker formed from ferrous material.

6. The putter of claim 4 wherein said putter body is formed of non-magnetic material, said ball marker retrieving device including a ferrous plug positioned in said second opening to attract a ball marker formed of magnetic material.

7. A putter used for playing a game of golf comprising:

a putter body having a ball striking face formed on a front side of said putter body for striking a golf ball during said game of golf, said putter body including a bottom side, a top side, and a rear side generally opposite to said front side, said bottom side having a central planar portion and a wing portion positioned laterally from said central planar portion, said wing portion being angled upwardly from said central planar portion wherein said wing portion has a step decrease in height between said front side and said rear side near said front side; and a magnetic ball marker retrieval device mounted in a hole formed in said wing portion of said bottom surface adjacent said front side rearwardly of said ball striking surface and adjacent to one end of said ball striking surface, said ball marker retrieval device being positioned vertically above said planar central portion when said central planar portion is engaged with the ground.

8. The putter of claim 7 further comprising:

a generally vertical opening formed into said bottom side of said putter, said opening having a minimum dimension separating two opposing surfaces, said minimum dimension being slightly smaller than a diameter dimension of said golf ball to permit said opposing surfaces of said vertical opening to engage opposing sides of said golf ball so that said golf ball can be wedged in said opening.

9. The putter of claim 8 wherein said putter body is formed with a size and configuration to permit the insertion of said putter body into a standard golf cup placed into the surface of a golf green, said generally vertical opening being positioned in a generally central location so that said opening can engage a golf ball located in said standard golf cup.

10. The putter of claim 9 wherein said generally vertical opening extends through both said top and bottom surfaces, passing through said putter body.

11. The putter of claim 7 wherein said putter body is formed of non-magnetic material, said ball marker retrieving device including a ferrous plug positioned in said hole to attract a ball marker formed of magnetic material.

12. In a putter body mounted on a shaft to form a putter used to play golf, said putter body having a ball striking face formed on a front side of said putter body for striking a golf ball during said game of golf, said putter body including a bottom side, and a top side generally opposite to said bottom side, the improvement comprising:

said bottom side having a central planar portion and a wing portion positioned laterally from said central planar portion on both sides of said central planar portion, both of said wing portions being angled upwardly from said central planar portion wherein said wing portions have a step decrease in height between said front side and a rear side near said front side;

a generally vertical opening formed into said central planar portion of said bottom side of said putter, said opening having a minimum dimension separating two opposing surfaces, said minimum dimension being slightly smaller than a diameter dimension of said golf ball to permit said opposing surfaces of said vertical opening to engage opposing sides of said golf ball so that said golf ball can be wedged in said opening;

said putter body being formed with a size and configuration to permit the insertion of said putter body into a standard golf cup placed into the surface of a golf green, said generally vertical opening being positioned in a generally central location so that said opening can engage a golf ball located in said standard golf cup;

one of said wing portions being aligned with said shaft extending upwardly from said putter body;

a magnetic ball marker retrieval device mounted in a second opening formed in the other of said wing portions of said bottom surface such that said ball marker retrieval device does not engage the surface of the ground as said central planar portion is engaged with the ground, and said first opening being located between said handle and said second opening.

13. The putter body of claim 12 wherein said magnetic ball marker retrieving device includes a magnet mounted in said hole formed in said bottom surface, said magnet attracting a ball marker formed from ferrous material.

14. The putter body of claim 12 wherein said generally vertical opening extends through both said top and bottom surfaces, passing through said putter body.

15. The putter body of claim 12 wherein said shaft is affixed to said top surface above said one wing portion.

* * * * *